United States Patent [19]

Neisler et al.

[11] 4,179,851

[45] Dec. 25, 1979

[54] APPARATUS FOR EDGING OPHTHALMIC LENSES

[75] Inventors: Boyd L. Neisler; Joe D. Stith, both of Muskogee, Okla.

[73] Assignee: Coburn Optical Industries, Inc., Muskogee, Okla.

[21] Appl. No.: 871,871

[22] Filed: Jan. 24, 1978

[51] Int. Cl.[2] ..... B24B 9/14; B24B 1/00

[52] U.S. Cl. ..... 51/101 LG; 51/284 E

[58] Field of Search ..... 51/101 LG, 284 E, 127, 51/101R, 97 NC

[56] References Cited

U.S. PATENT DOCUMENTS

| | | | |
|---|---|---|---|
| 1,254,253 | 1/1918 | Marchant | 51/101 LG |
| 1,502,990 | 7/1924 | Kiefer | 51/101 R |
| 2,209,605 | 7/1940 | Maynard | 51/101 LG |
| 2,963,831 | 12/1960 | Voelz | 51/127 |
| 3,158,967 | 12/1964 | Reaser | 51/101 LG |
| 3,461,619 | 8/1969 | Hurlbut et al. | 51/101 LG |
| 3,498,005 | 3/1970 | Brandt | 51/101LG |
| 3,894,361 | 7/1975 | Georgiadis et al. | 51/101 LG |

*Primary Examiner*—Harold D. Whitehead
*Assistant Examiner*—K. Bradford Adolphson
*Attorney, Agent, or Firm*—John J. Byrne; Edward E. Dyson

[57] ABSTRACT

An apparatus for simultaneously grinding a peripheral shape and edge surface upon a pair of ophthalmic lenses with a single pattern. The apparatus includes an abrading wheel and first and second floating heads for rotatably supporting a pair of ophthalmic lenses on either side of the abrading wheel. The lenses are biased toward the wheel and are incrementally rotated about mutually parallel axes which lie parallel with a central longitudinal axis of the abrading wheel. A control system is operably connected to each of the lenses and serves to control incremental rotation of each of the lenses as well as lateral engagement of the lenses with the central abrading wheel.

6 Claims, 17 Drawing Figures

FIG.1
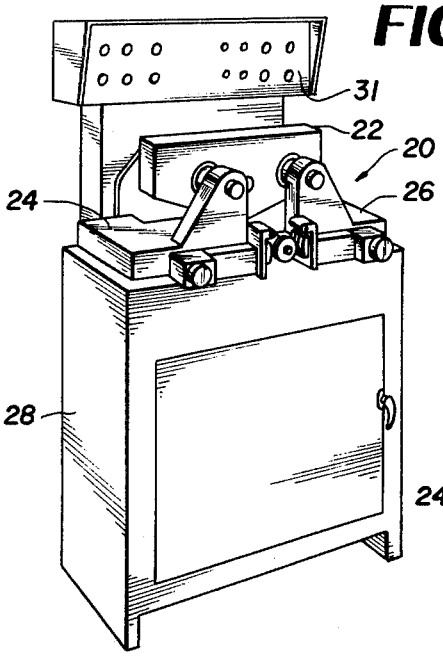
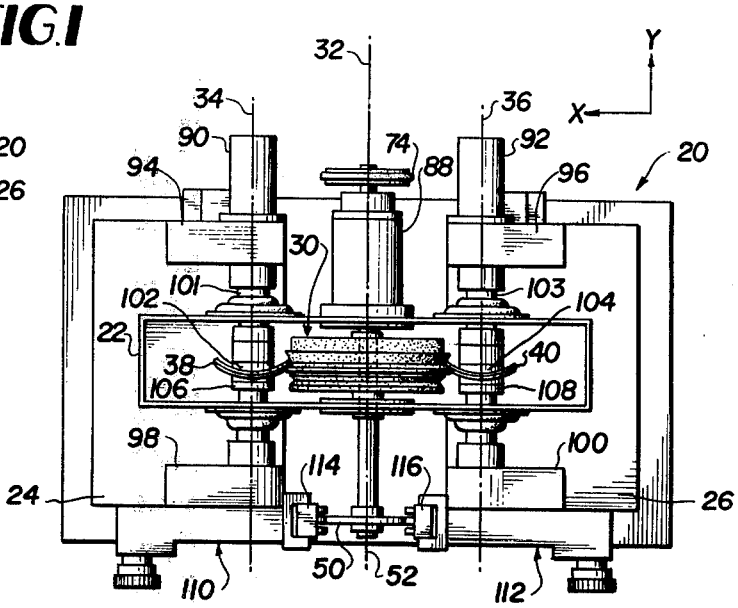
FIG.7
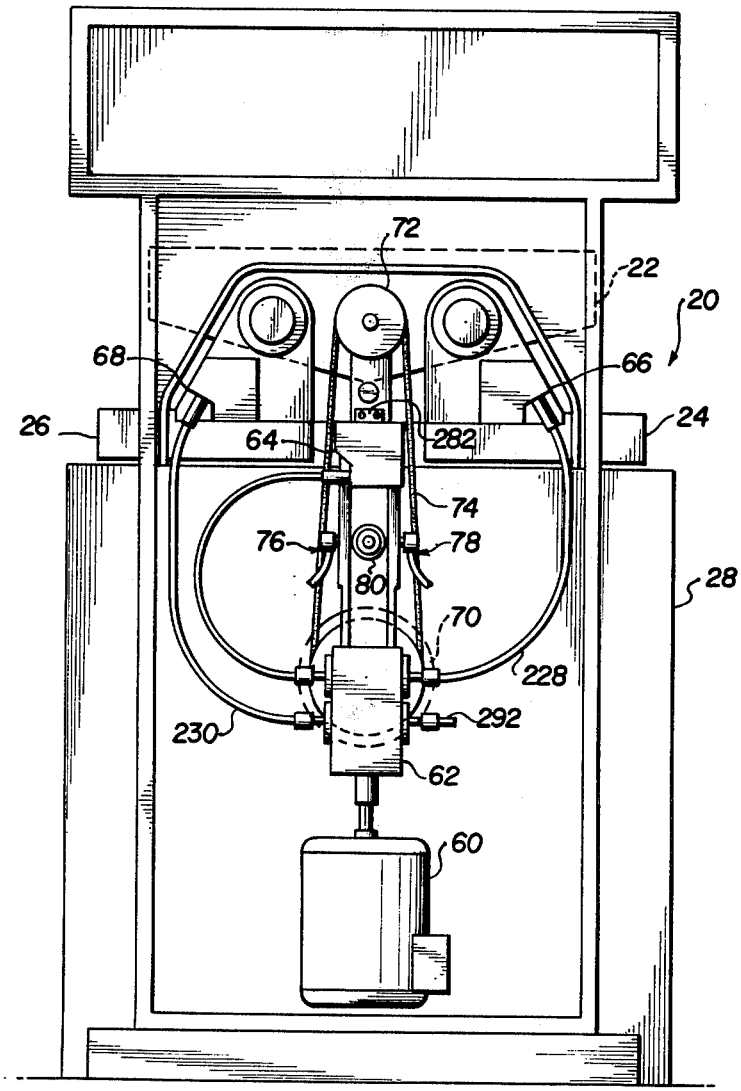
FIG.6

FIG. 4
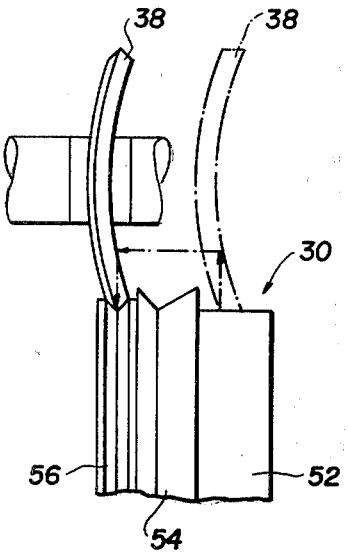
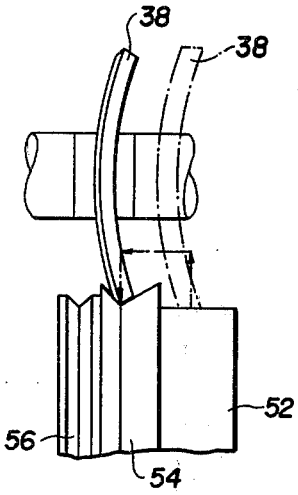
FIG. 5
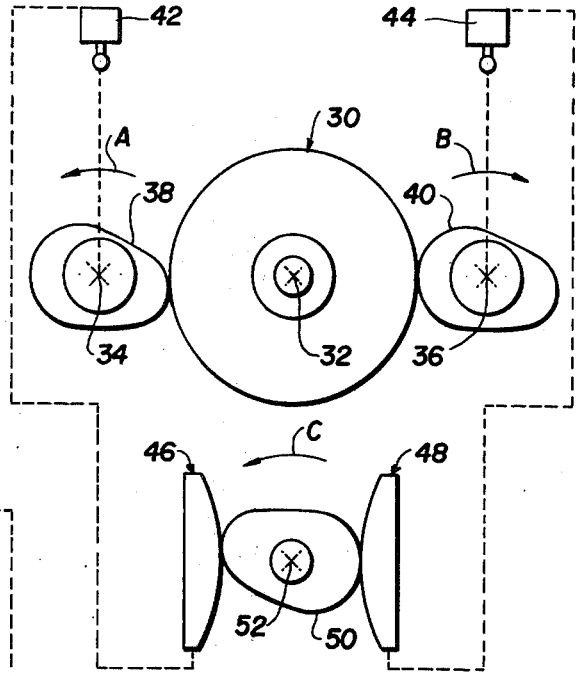
FIG. 3
FIG. 2
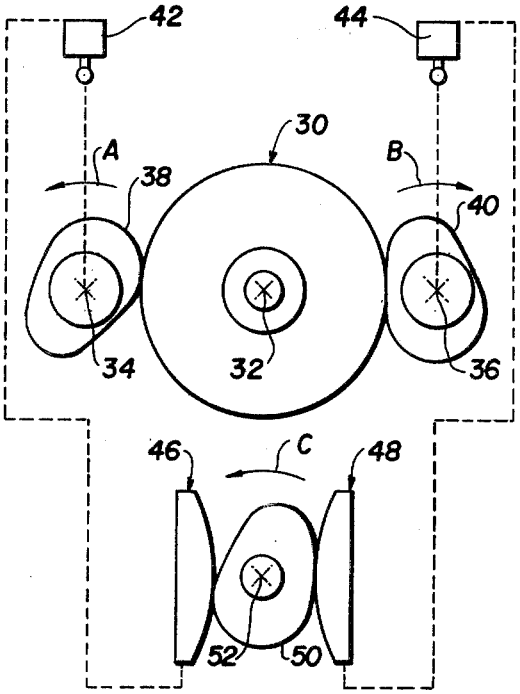

FIG.16
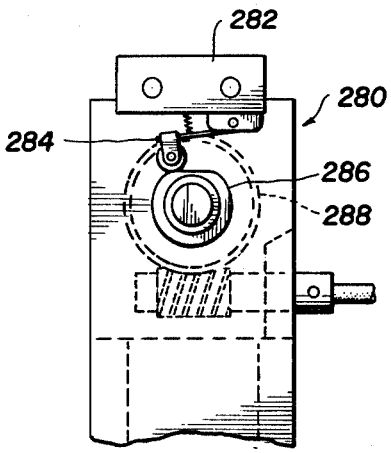
FIG.17
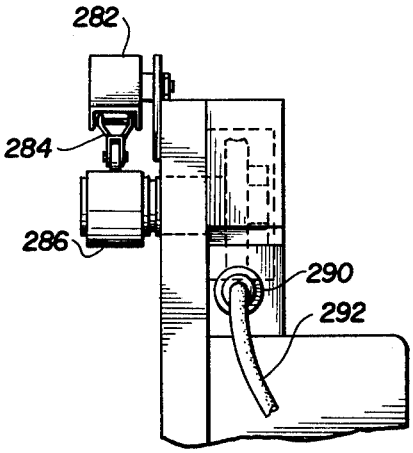
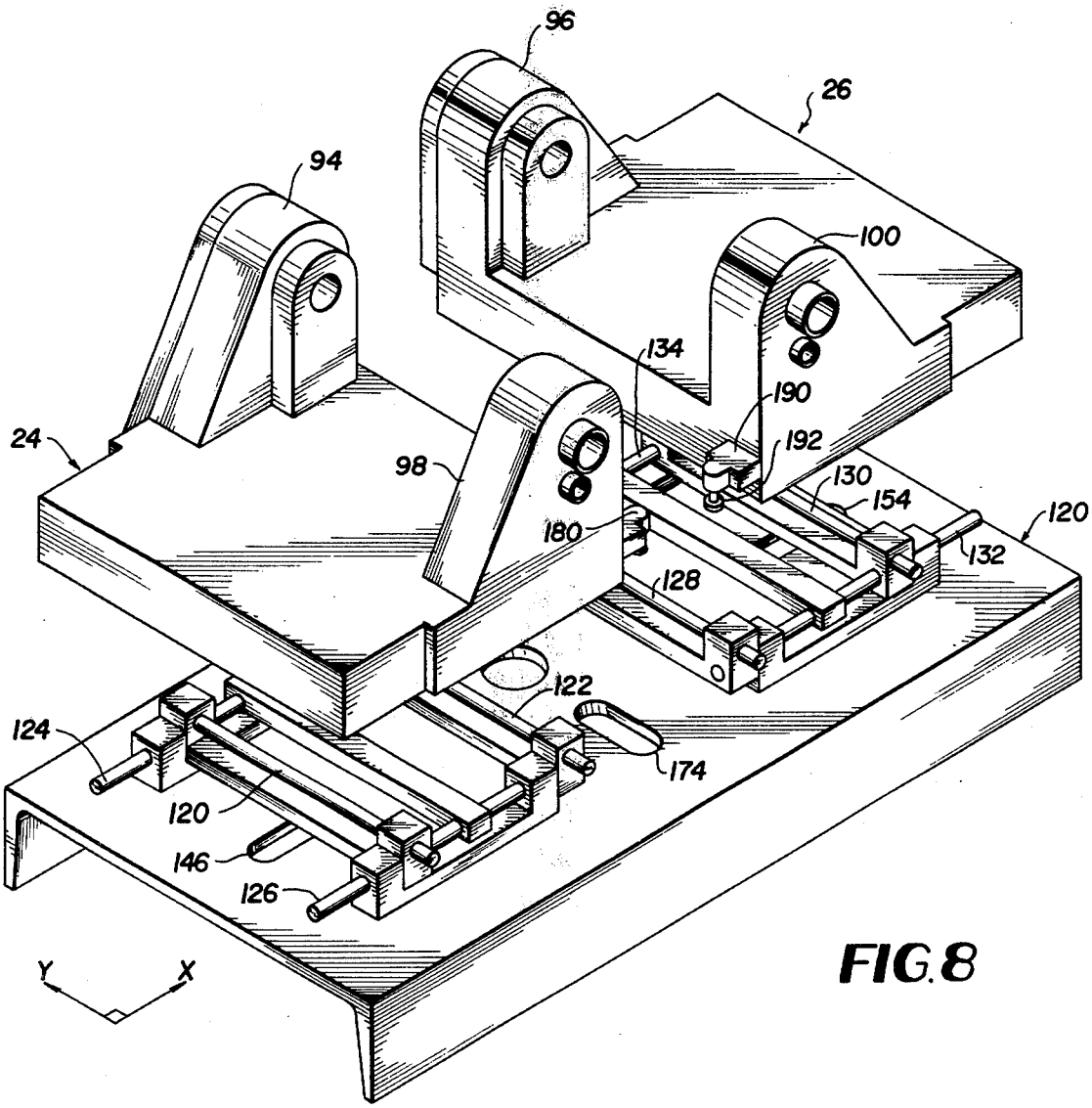
FIG.8

APPARATUS FOR EDGING OPHTHALMIC LENSES

BACKGROUND OF THE INVENTION

This invention relates to an apparatus for grinding an edge shape and peripheral surface configuration upon ophthalmic lenses.

The art of preparing ophthalmic lenses from glass blanks entails two major processes. First, the circular lens blanks are surface ground with a prescriptive front and back curvature to provide a desired optic quality or characteristic and thus enhance the vision of an ultimate wearer. Secondly, the lenses are ground to a desired edge shape to fit a preselected frame. Additionally, the peripheral edge surface of lenses are typically beveled or finished to cooperate with a reciprocal bevel on an interior peripheral surface of a frame in order to hold the lenses within the frame.

In the past at least one process of lens edging has been achieved by mounting a single lens upon a laterally fixed spindle or chucking mechanism and advancing an abrading wheel into lateral contact with the lens. The process is then repeated on an additional blank to produce a matching set or pair of lenses.

In another previously known process a lens to be edge ground is horizontally mounted about a vertical axis. A pair of grinding wheels are vertically mounted for rotation on either side of the lens for selective advancement into grinding engagement with the central lens. Each of the grinding wheels is fashioned with an oppositely sloping peripheral surface. Accordingly, one wheel contacts a front peripheral portion of the lens and the other wheel contacts a back peripheral portion of the lens. In combination the two grinding wheels form a beveled peripheral edge on the lens. Lateral control of the abrading wheels is achieved by a pair of conical cam followers which ride against a generally disc shaped cam. Once completed the lens is removed and the process is repeated on a second lens blank to produce a pair.

Although lens edging equipment of the foregoing and similar designs have received at least a degree of attention and acceptance in the art, room for improvement remains.

In this connection, edge grinding a pair of lenses on presently known machines is somewhat time consuming and requires a degree of operator attention and control.

Additionally, previously known edging devices are limited to grinding a single lens at one time and thus lack a certain degree of uniformity and symmetry desired of a pair of lenses.

Further, presently known machines do not provide a capability for edging a pair of lenses in a manner to sequentially remove excess glass and then fine grind a desired edge configuration.

Still further, the known prior art devices do not exhibit a capability for simultaneously grinding a pair of lenses or facilely varying the size for a given lens shape.

The difficulties suggested in the preceeding are not intended to be exhaustive, but rather are among many which may tend to reduce the effectiveness and user satisfaction of prior lens edging methods and apparatus. Other noteworthy problems may also exist; however, those presented above should be sufficient to demonstrate that ophthalmic lens edging machines and techniques appearing in the past will admit to worthwhile improvement.

OBJECTS OF THE INVENTION

It is therefore a general object of the invention to provide a novel apparatus for edging ophthalmic lenses which will obviate or minimize difficulties of the type previously described.

It is a specific object of the invention to provide a novel apparatus for edging ophthalmic lenses which will significantly reduce the time required to edge a pair of lenses.

It is another object of the invention to provide a novel apparatus which will enhance the symmetry and uniformity of a pair of lenses produced by an edge grinding operation.

It is still another object of the invention to provide a novel apparatus for edging a pair of ophthalmic lenses wherein a coarse grinding operation may be utilized to quickly remove large amounts of glass followed by a finer finishing operation without operator intervention.

It is a further object of the invention to provide a novel apparatus for simultaneously edge grinding a pair of ophthalmic lenses wherein the finish size of a pair of lenses may be facilely controlled for any given lens shape.

It is yet a further object of the invention to provide a novel apparatus for edge grinding a pair of ophthalmic lenses simultaneously in one operation.

THE DRAWINGS

Other objects and advantages of the present invention will become apparent from the following detailed description of a preferred embodiment taken in conjunction with the accompanying drawings, wherein:

FIG. 1 is an axonometric view of a dual head floating edge grinder for ophthalmic lenses in accordance with a preferred embodiment of the invention;

FIG. 2, note sheet 2, discloses a schematic control system utilizing a central lens pattern in simultaneous contact with left and right contact switches to control angular rotation and lateral movement of right and left lenses to be edge ground respectively;

FIG. 3 is a schematic representation similar to FIG. 2 wherein the pattern has been rotated with respect to the position of the lenses depicted in FIG. 2;

FIG. 4 is a schematic representation of a rough shaping operation and a final bevel edge grinding step for an ophthalmic lens;

FIG. 5 is another schematic view similar to FIG. 4 of a coarse shaping operation followed by a final alternate bevel edge grind;

Figure 9:
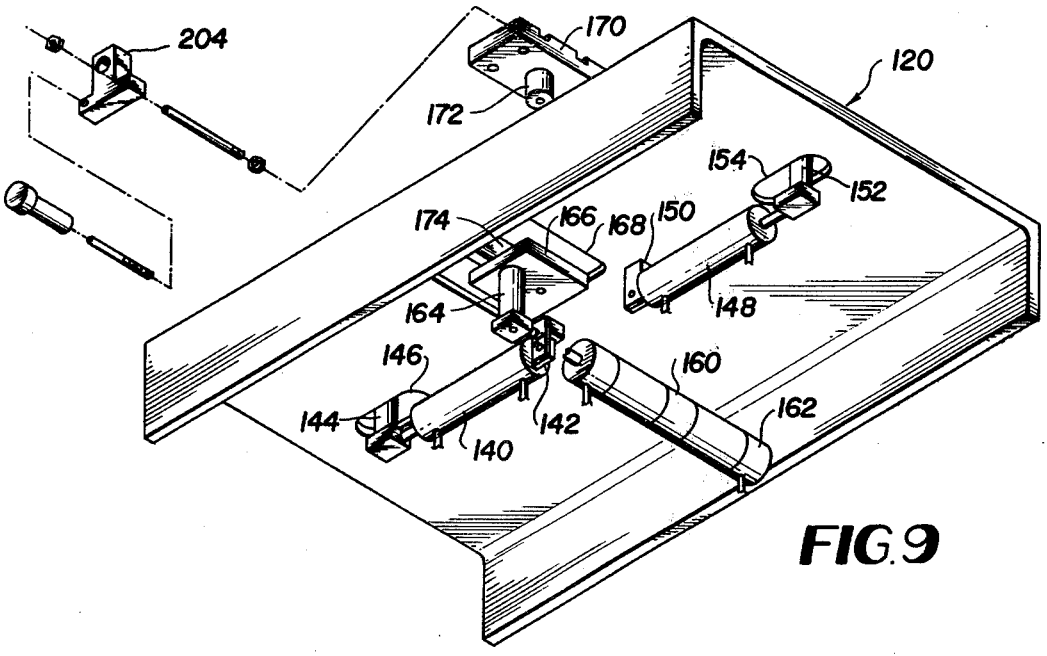
Figure 10:
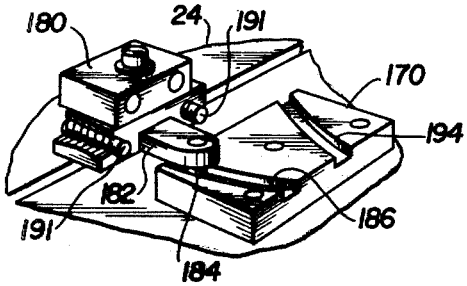
Figure 11:
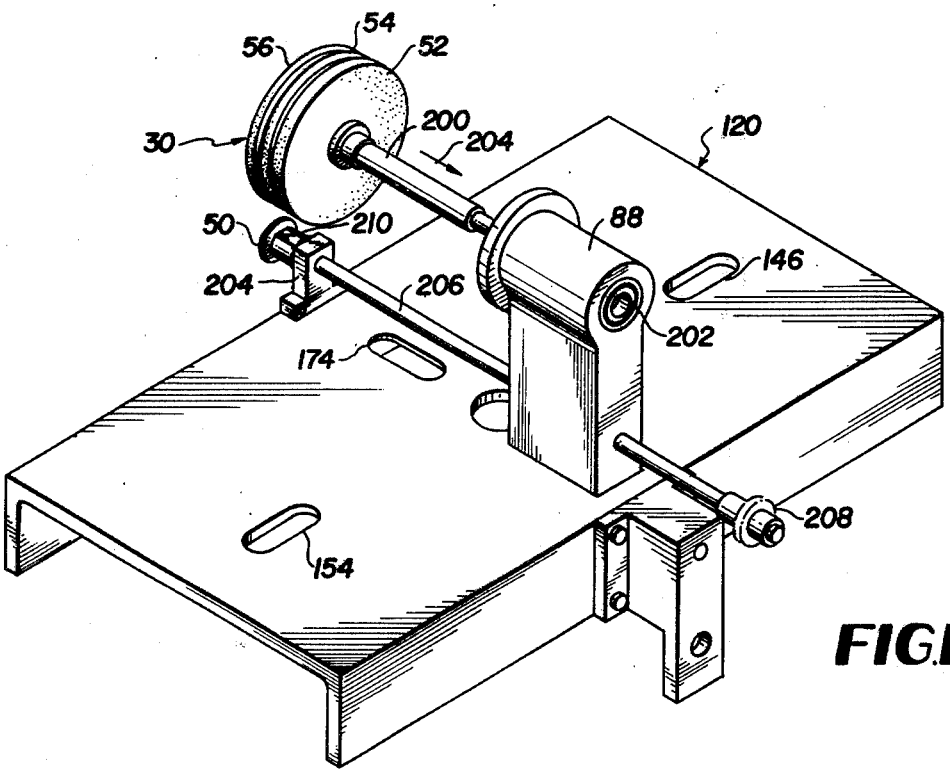
Figure 15:
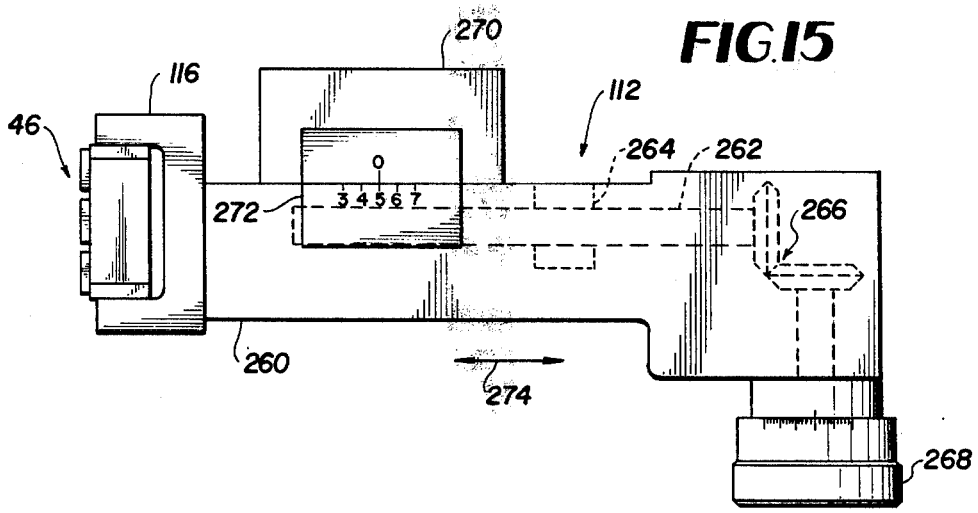
Figure 14:
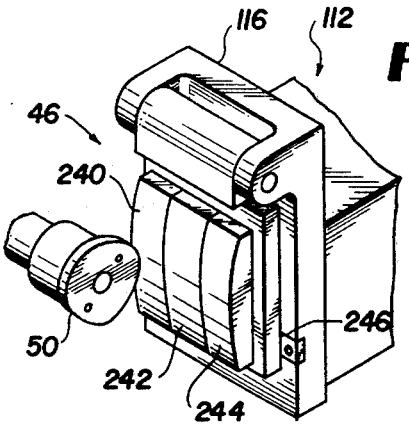
Figure 13:
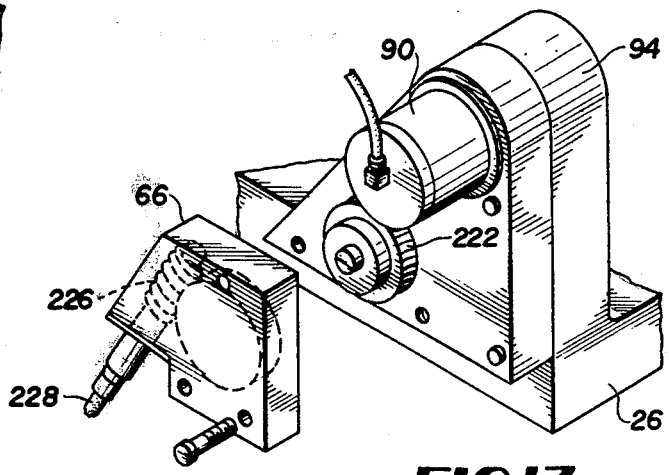
Figure 12:
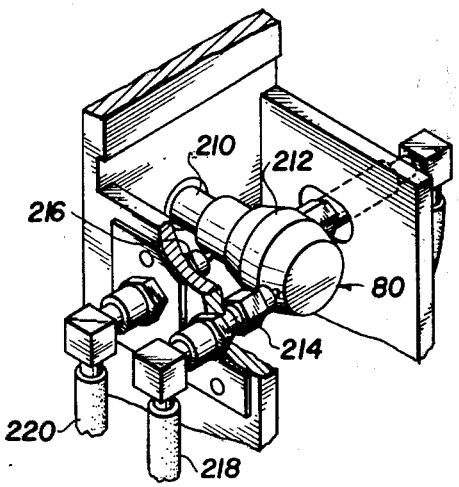

FIG. 6, note sheet 1, is a rear elevational view of the dual head edger including a drive system for controlling rotation of lens blanks during an edge grinding operation;

FIG. 7 is a plan view of the dual head edger disclosing a pair of floating heads carrying a pair of ophthalmic lenses for a simultaneous grinding operation upon diametrical sides of a central abrading wheel;

FIG. 8, note sheet 3, is an expanded axonometric view of a portion of a floating head assembly including left and right floating heads operable for X–Y coordinate movement;

FIG. 9, note sheet 4, is a bottom view of a base portion of the dual head edger including X–Y motion actuating assemblies;

FIG. 10 is a partial detail view of a bevel positioning block and upper slide block for positioning the lens blanks with respect to the grinding wheel;

FIG. 11 is a partial axonometric view of a base portion of the dual edger including a quill body and pattern support;

FIG. 12, note sheet 5, is a detail view of a cam assembly which controls air cylinder limit valves in accordance with the invention;

FIG. 13 is an expanded partial axonometric view of a drive system for rotation of a lens blank mounted upon one of the edger floating heads;

FIG. 14 is a detail perspective view of a lens pattern and three part switching assembly which controls angular movement of a lens to be edge ground;

FIG. 15 is a plan view of a size adjustment mechanism for positioning the contact switch disclosed in FIG. 14;

FIG. 16, note sheet 3, is a front view of a microswitch which assists in control of termination of the lens edging operation; and FIG. 17 is a side elevational view of the microswitch depicted in FIG. 16.

DETAILED DESCRIPTION

Referring now to the drawings and particularly to FIG. 1 thereof, there will be seen an axonometric representation of a dual head edge grinding unit 20 in accordance with a preferred embodiment of the invention. The dual grinding unit 20 includes a lens grinding chamber 22, a left floating head 24 and a right floating head 26. The floating heads are carried by a base member which in turn is supported upon a cabinet 28. The cabinet 28 additionally serves to house a coolant tank and a system pump, not shown. A control panel 31 is mounted above the grinding chamber 22 and is fitted with an appropriate array of units to monitor and control an edge grinding operation.

Before discussing in detail the structural features of the invention, it may be worthwhile to establish in functional terms the general operating concept of the dual edge grinding unit 20. In this regard, the reader's attention is invited to FIGS. 2 through 5, on sheet 2 of the drawings, where a grinding or abrading diamond wheel 30 is schematically disclosed upon a central longitudinal axis 32. On either side of the first axis 32 are second and third mutually parallel axes 34 and 36 respectively, which in turn extend parallel with the grinding wheel axis 32. A first 38 and second 40 ophthalmic lens to be edge ground is mounted transversely to the axes 34 and 36 respectively and in radial juxtaposition to and upon opposite sides of the grinding wheel 30.

The angular relationship of lenses 38 and 40 with respect to the abrading wheel 30 is controlled by drive units 42 and 44. The drive units are carried by the left and right floating heads 24 and 26.

The drive units 42 and 44 are actuated to rotate the lenses 38 and 40 in response to the lateral position of contact pads or paws 46 and 48 which are also carried by the floating heads 24 and 26. The contact pads extend upon opposite sides of a lens pattern 50 which is mounted about a fourth axis 52 extending parallel to axes 32, 34 and 36.

In brief operation the lens are held in a rotationally stationary posture and biased against the abrading wheel until the contacts 46 and 48, which are mounted upon the floating heads, engage the peripheral surfaces of pattern 50. At this point an electrical contact is made and the pattern and lenses are rotated to the next preselected angular position which is preferably one degree of angular movement. Contact of the excess glass portion of the lens to be ground away then pushes the floating heads away from the abrading wheel which in turn carries the contact paws 46 and 48 away from contact with pattern 50. When the paws 46 and 48 are withdrawn from the pattern 50 an electrical contact is broken and rotation of the lenses and pattern ceases. As abrading progresses the excess glass is ground away from the lenses 38 and 40 until the paws return to contact with the pattern. Electrical contact will again be made and the lenses and pattern will be rotated to the next angular position and the sequence will be repeated.

In the above regard, it will be seen, by reference to FIG. 3, that the pattern and lenses have rotated approximately 90 degrees in the direction of arrows A, B and C. As the grinding operation progresses the lenses and pattern will be stepped about the second, third and fourth axes a full 360 degrees of revolution.

Turning now to FIGS. 4 and 5, the abrading wheel 30 may consist of a plurality of individual wheels 52, 54 and 56 which comprise a coarse grinding wheel 52 to rapidly remove excess glass from the lens blank and selective finishing wheels 54 and 56 which simultaneously finalize the overall shape of the lenses and fashion a bevel edge around the periphery of the lenses so that the lenses may be retained within glasses frames.

Returning to the structural details of the dual edge grinding unit 20, FIG. 6, note sheet 1, discloses an electric motor 60 which serves to operate a primary gear box 62 which in turn is connected to a pattern drive gear box 64 and left and right floating head gear boxes 66 and 68 respectively. Another electric motor 70 is mounted within the base cabinet 28 and serves to drive a diamond wheel grinding spindle 72 by a flexible drive belt 74. Air limit valves 76 and 78 are positioned upon opposite sides of a cam control unit 80 which will be discussed more fully below.

Referring now to FIG. 7, there will be seen a top view of the dual head edger 20. The left and right floating heads 24 and 26 are mounted for X–Y coordinate movement upon each side of the abrading wheel 30.

The abrading wheel 30 is mounted upon a first axis 32 extending through a support quill 88. Ophthalmic lenses 38 and 40 to be edge ground are chucked and mounted transversely upon mutually parallel axes 34 and 36. Air cylinders 90 and 92 are mounted respectively upon rear stanchions 94 and 96 which in turn are carried by the left and right floating heads 24 and 26. Forward stanchions 98 and 100 are also carried by the floating heads and are positioned along axes 34 and 36 to carry the forward ends of lens shafts 101 and 103 respectively. The lenses 38 and 40 to be edge ground are held in place by felt pads 102 and 104 against chucks 106 and 108 by pressurization of the air cylinders 90 and 92.

A lens pattern 50 is mounted for rotation about a fourth axis 52 which extends in a mutually parallel posture with respect to the previously identified axes of grinding wheel 32 and lenses 34 and 36.

A size control unit 110 is mounted upon the left floating head 24 and a similar size control unit 112 is mounted upon the right floating head 26. These size control units terminate at one end with plate holders 114 and 116 designated to carry a plurality of contact plates or paws 46 and 48 which will be discussed more fully below.

Referring now to sheet 3 and FIG. 8, there will be seen an expanded axonometric view of the floating heads 24 and 26 with respect to an underlying base 120. As previously noted, the left floating head 24 includes a rear stanchion 94 and oppositely positioned forward stanchion 98 which serve to support a first lens to be edge ground. In a similar manner, the right hand floating head 26 includes a rear stanchion 96 and an oppositely positioned forward stanchion 100 which serve to support a second lens to be ground.

The floating head 24 is mounted upon an X–Y coordinate way system carried by the base 120. The head is connected to parallel ways 121 and 122 for translation of the floating head 24 from the front to the rear in a "Y" direction. In a similar manner, ways 120 and 122 are mounted upon normally extending parallel ways 124 and 126 for translation of the floating head 24 along an "X" axis directed laterally with respect to the base 120.

The floating head 26 is also mounted upon an X–Y coordinate system of ways including a first pair of parallel rods 128 and 130 which serve to permit movement of the floating head 26 in the "Y" direction with respect to the machine. The first pair of ways in turn are mounted upon a second set of ways 132 and 134 which are connected to the base 120 and permit the head 26 to be laterally translated in an "X" direction along the base as desired.

FIG. 9, note sheet 4, discloses a partially detailed bottom view of the base 120 and includes a system for driving the floating heads upon the above detailed ways in an X–Y rectilinear manner. Lateral or "X" movement of the left floating head 24 is achieved by controlled actuation of a first air motor 140 which is mounted at one end 142 upon the bottom surface of the base 120. A piston portion of the motor 140 extends outwardly from the free end thereof and is connected by a link 144, which extends through an elongated aperture 146, to the bottom surface of the floating head 24.

In a similar manner, a second air motor 148 is mounted at one end 150 directly to the base plate 120. A piston within the air motor 148 extends outwardly from the free end thereof and is connected by a link 152, which extends through an elongated aperture 154 in the base plate to the floating head 26. The connecting column 152 in turn is mounted upon the underside of floating head 26.

The air motors 140 and 148 can be actuated in either direction through air lines connected at the opposite ends thereof. Accordingly, lateral or "X" motion of the floating heads 24 and 26 with respect to the central axis 32 of the cutting head may be controlled in either direction. Moreover, upon application of a predetermined amount of air pressure each of the floating heads may be biased by the motors toward the central axis 32 during a grinding operation.

A third motor 160 is mounted within the base 120. One end of the motor 160 is mounted against a downwardly extending wall of the base 120 as at 162. A piston rod within the motor 160 extends outwardly from the free end thereof and is affixed to a connecting column 164 which is mounted upon a lower slide block 166.

The slide block 166 is free to move within a recess 168 cut into the base 120. An upper slide block 170 is connected to the lower slide block 166 by a spacer column 172 which extends through an elongated aperture 174 in the base plate. Accordingly, the upper and lower slide blocks move in unison upon actuation of the motor 160.

The upper slide block 170 is connected on one side to the floating head 24, note FIG. 10, by a bevel positioning block 180. The bevel positioning block includes a cantilever arm 182 having a downwardly extending roller 184 which projects into an arcuate raceway 186 of the block 170. Accordingly, translation of the upper slide block 170 will serve to concomitantly move the floating head 24 along the previously disclosed guide ways 120 and 122. In a similar manner another bevel position block 190 is connected to the right floating head 26, note FIG. 8, and includes a roller 192 which is operable to be received with an arcuate raceway 194 of the slide block 170. Translation of the slide block 170 will thus serve to move the floating head 26 along ways 128 and 130. The bevel position blocks 180 and 190 are each fashioned with adjusting screws 191 which serve to pivot the blocks and provide fine bevel adjustments to the lenses in relation to the grind wheel.

Referring to FIG. 11, there will be seen a partial view of a grinding wheel and pattern holder in an expanded condition. More particularly, the base 120 serves to carry a quill 88 which receives a shaft 200 within bearings 202 in the direction of arrow 204. The shaft 200 is operable to carry a plurality of axially spaced grinding wheels 52, 54 and 56 as previously discussed.

A pattern rod guide 204 is mounted upon a forward portion of the base 120 and serves to receive a pattern drive shaft 206 which in turn is carried by a sleeve bearing through the quill body 88. A worm gear 208 is mounted upon the rearward extremity of the pattern drive shaft 206 and is received within the pattern drive gear box 64, note FIG. 6. The pattern 50 is mounted upon the forward end of the drive shaft via a conventional pattern holder 210.

In FIG. 12, note sheet 5, there will be seen a cam unit 80 connected to a shaft 210 which in turn is mounted upon the lower slide block 166, note FIG. 9. The actual connection of shaft 210 with the slide block 166, is not shown, but the coupling is a direct one with conventional fasteners. Accordingly, as the floating heads are traversed forward and backward in the "Y" direction the cam unit 80 will move forward and backward and upwardly extending peripheral band 212 of the cam 80 will come in contact with air pressure limit valves 214 and 216. The limit valves are connected to pressurized air conduits 218 and 220 respectively to limit forward and rearward actuation of the cylinder 160 and thus "Y" motion of the floating heads 24 and 26.

Referring now to FIG. 13 there will be seen a rear view of a portion of the left floating head 26 and the rear stanchion 96 which serves to carry an air cylinder 90 for mounting a lens 40 to be ground. The left head gear box 66 is shown in an expanded posture and separated from a first chuck worm gear 222 of a gear train which ultimately connects to shaft 103, note FIG. 7 on sheet 1, shaft 103 in turn is connected to the lens 40 to be edge ground. Rotation of the chuck worm gear 222 is initialed by a mating worm 226 which in turn is driven by a flexable connector connected to gear box 62. A similar unit is provided on the left floating head 24 to rotate the lens 38.

As previously discussed, a pattern plate holder 116 is connected to a size control unit 112 mounted upon the floating head 26. A partial isometric view of this structure is depicted in FIG. 14. The pattern plate holder 116 carries a pattern plate 117 which in turn carries a plurality of pattern plates or paws 46. These paws include individual contact elements 240, 242 and 244 which are spring biased outwardly away from an electrical contact bar 246.

The contact elements 240–244 serve to control rotation of an associated lens with respect to grinding wheels 52, 54 and 56 respectively. In this regard, when the contact paws 46 are pivoted away from the dwell contact bar 246 the lenses and pattern will be held in a stationary position. However, when one of the paws makes contact with the dwell bar 246, as when the pattern 50 pushes the paw against its outward spring bias, the lenses and pattern will be rotationally driven until contact is again broken.

Referring now to FIG. 15, there will be seen a detailed plan view of the size control unit 112. As previously mentioned, this unit is mounted upon floating head 26 and serves to control the size of the lens to be ground for any given pattern shape. In this regard, the pattern plate holder 116 is connected to a column 260 which in turn can be laterally adjusted with respect to the floating head 26. This adjustment is provided by rotating a shaft 262 which extends through a collar 264 mounted upon the floating head. Rotation of the shaft is controlled through a set of bevel gears 266 upon rotation of a hand operated control knob 268. A zero position marker 270 is mounted upon the floating head 26 and serves to register with size control indicia carried by the shaft 260 as at 272. Rotation of the hand control 268 will serve to rotate threaded shaft 262 and advance or retract the contact pads 46 in the directions of arrows 274 with respect to the pattern 50.

Returning now to sheet 3, there will be seen a microswitch unit 280 which functions to turn off the machine following a grinding operation. The microswitch unit 280 includes a conventional microswitch 282 with a cantilever cam follower 284 which rides upon a cam surface 286. Rotation of the cam surface is controlled by a worm gear 288 which in turn is rotated by a worm 290 connected to a drive cable 292.

Having now described the major structural features of the subject dual head edger, an overall method of operation initially entails mounting a pair of lenses 38 and 40 to be edge ground upon shafts 101 and 103 of the floating heads 24 and 26 respectively. Referring again to FIGS. 2 and 3, the pattern 50 is rotated in a counterclockwise direction "C" between the contact pads 46 and 48 while the lens 38 is rotated in a counterclockwise direction "A" and lens 40 is rotated in a clockwise direction "B".

The air motors 140 and 148 serve to continually bias the lenses to be edge ground initially into contact with the coarse diamond cutting wheel 52.

The lenses 38 and 40 which start out in a generally circular shape are rapidly ground down on the coarse wheel 52 at a given angular position until the contact pads 46 and 48 which are carried by the floating heads 24 and 26 come in contact with pattern 50. Upon reaching pattern 50 an electrical signal is transmitted through the dwell contact bars 246 and the gear drive units 66 and 68 along with the pattern drive unit 64 advance the lenses and pattern a degree of angular rotation whereupon the excess glass of the lenses will force the floating heads contacting the grinding wheel 52 outwardly which in turn carry the contact pads 46 and 48 away from the pattern 50. As the contact pads or paws 46 and 48 leave the pattern 50 they are self biased outwardly to break an electrical contact with the bar 246. With this contact broken rotation of the lenses and pattern will cease and the lenses and pattern will dwell in this angular position.

As grinding proceeds at this angular position under the inward bias of the air cylinders 140 and 148 the contact pads 46 and 48 will again engage the pattern 50 whereupon electrical contact will restablished with the bars 246 and the motor 60 will drive the appropriate gear boxes and the pattern and lenses will each be rotated until the glass in contact with the wheel 52 again induce a break in contact between the paws 46 and 48 and contact bars 246.

This sequence of operation continues until the lenses have completed a full revolution and are ground down to assume the general configuration of the pattern 50. At this point in time the cycle is repeated upon a substantially continuous basis whereby the contact paws 46 and 48 remain in continuous engagement with the pattern 50. A timer unit, now shown, times a complete revolution of the pattern. After the timer has timed out current is allowed to flow to the microswitch 280. One cycle typically takes about seven seconds. Upon this complete revolution of the pattern in continuous contact with the paws 46 and 48 and simultaneous complete revolution of the microswitch cam 286 current will pass through the microswitch to activate a solenoid and the hydraulic cylinders 240 and 248 will be extended to withdraw the lenses radially out of engagement with the coarse grinding wheel 52, note FIGS. 4 and 5. The lenses will then be translated via cylinder 160 to a predetermined finishing wheel 54 or 56 designed to provide a finishing grind and bevel edge upon the lens.

In this second position the process is again repeated in an angular incremental mode until the contact paws remains in engagement with the pattern 50 for two complete revolutions as timed by a timer, not shown. Upon two complete revolutions the timer is synchronized with the microswitch 282 to actuate the cylinders 140 and 148 to withdraw the lenses from contact with the abrading wheel and stop the machines.

An operator then dechucks the lenses, inserts new lenses to be ground and the process is repeated.

In describing a method and apparatus for edge grinding ophthalmic lenses in accordance with a preferred embodiment of the invention, those skilled in the art will recognize several advantages which singularly distinguish the invention from previously known methods and apparatus.

A particular advantage of the invention is that the subject method and apparatus for edge grinding ophthalmic lenses provides a system whereby a pair of lenses may be simultaneously edge ground. This simultaneous grinding minimizes the amount of machine time while maximum utilization of the abrading wheel is achieved. Additionally, the symmetry of the pair of lenses edge ground on the subject invention is heightened by the fact that the lenses are simultaneously ground from a single pattern.

The subject invention further utilizes a plurality of grinding diamond wheels, axially spaced with respect to one another, and upon completion of a coarse grinding operation at wheel 52 the lenses are backed out axially, advanced and engaged with a predetermined finish and bevel wheel 54 or 56. This process is automatically controlled through the provision of timing units and microswitches which control the in-process motion of the lenses.

In addition, the size control units 110 and 112 may be manually adjusted prior to a grinding operation to control the finished dimensions of the lenses for any given shape. Accordingly, the number of patterns 50 which are required are reduced in that the pattern pre se merely provides the intended shape while the units 110 and 112 control the size.

By the provision of a method and apparatus for grinding a pair of ophthalmic lenses simultaneously, the overall time consummed by the edging operation is significantly reduced. Moreover, through the provision of a coarse and fine grinding sequence the actual grinding time of subject invention is minimized.

In describing the invention, reference has been made to a preferred embodiment. Those skilled in the art, however, and familiar with the disclosure of the subject invention, may recognize additions, deletions, modifications, substitutions, and/or other changes which will fall within the preview of the invention as defined in the following claims:

What is claimed is:

1. An apparatus for grinding an edge configuration upon ophthalmic lenses comprising:

abrading wheel means mounted for rotation about a first horizontally extending axis;

means connected to said abrading wheel means for rotating said abrading wheel means about said first axis;

first means for rotatably mounting a first lens to be edge ground about a second horizontal axis extending parallel to said first axis, said first means for rotatably mounting including, first means for translating said second parallel axis in a horizontal plane toward and away from said first axis for selectively engaging a peripheral portion of the first lens with a peripheral portion of said abrading wheel means said first means for translating including, first head means mounted upon one side of said abrading wheel for translation in an X–Y coordinate horizontal plane toward and away from said axis of said abrading wheel means, and a first lens chucking assembly for securely holding a first lens and being journaled at the ends thereof within a pair of opposing stanchion means mounted upon said first head means;

second means for rotatably mounting a second lens to be edge ground about a third horizontal axis extending parallel to said first axis, said second means for rotatably mounting including, second means for translating said third parallel axis in a horizontal plane toward and away from said first axis for selectively engaging a peripheral portion of the second lens with another peripheral portion of said abrading wheel means said second means for translating including, second head means mounted upon the other side of said abrading wheel for translation in an X–Y coordinate horizontal plane toward and away from said axis of said abrading wheel means, and a second lens chucking assembly for securely holding a second lens and being journaled at the ends thereof within a pair of opposing stanchion means mounted upon said second head means;

first means for rotating the first lens about said second axis;

second means for rotating the second lens about said third axis;

motor means connected to said first and second head means for selectively translating said first and second head means in an X–Y horizontally planar coordinate toward and away from abrading wheel, said motor means includes means for biasing said first and second head means toward said abrading wheel and said first and second lenses into engagement with the periphery of said abrading wheel upon generally opposite sides of said abrading wheel; and means operably connected to said first and second means for rotatably mounting said first and second lenses for controlling the angular orientation and radial position of the first and second lenses relative to said abrading wheel means in accordance with a desired peripheral configuration of the first and second lenses, said means for controlling including, single pattern means mounted for rotation upon a fourth axis lying parallel to said first, second and third axis, first switch contact means mounted adjacent said pattern means, means connecting said first switch contact means to said means for rotating said first lens for controlling rotation of said first lens upon engagement of said switch contact means with said pattern means, second switch contact means mounted adjacent said pattern means, and means connecting said second switch contact means to said means for rotating said second lens for controlling rotation of said second lens upon engagement of said switch contact means with said pattern means.

2. An apparatus for grinding an edge configuration upon ophthalmic lenses as defined in claim 1 wherein:

each of said switch contact means are laterally positionable to adjust the size of the lenses being edge ground.

3. An apparatus for grinding an edge configuration upon ophthalmic lenses as defined in claim 1 wherein:

said first means for rotating the first lens includes, means for rotating the first lens in sequential incremental steps;

said second means for rotating the second lens includes, means for rotating the second lens in sequential incremental steps; and means connected to said pattern means for rotating said pattern means in sequential incremental steps in synchronization with sequential incremental rotation of said first and second lenses.

4. An apparatus for grinding an edge configuration upon ophthalmic lenses as defined in claim 3 and further comprising:

control means operably connected to said first and second means for rotating said first and second lenses and said means for rotating said pattern for terminating the edge grinding operation upon grinding of the peripheral edge shape of the lenses in conformance with the peripheral edge shape of the pattern.

5. An apparatus for grinding an edge configuration upon ophthalmic lenses as defined in claim 4 wherein said control means includes:

means for rotating said first and second lenses at least one additional revolution following a first complete revolution of said pattern and said first and second lenses.

6. An apparatus for grinding an edge configuration upon ophthalmic lenses as defined in claim 4 wherein:

said abrading wheel comprises a composite structure of at least two axially spaced grinding wheels wherein one of said wheels is constructed of a first degree of abrading coarseness and radial dimension and one other of said at least two axially spaced grinding wheels is constructed of a second degree of abrading coarseness which is finer than said one wheel and the radial dimension of said one other wheel being greater than the radial dimension of said one wheel wherein a coarse grind of said first and second lenses may be achieved by contact with said one wheel and a finer finish grind may be achieved by contact of said first and second lenses with at least two axially spaced grinding wheels; and means for axially advancing said first and second lenses from radial alignment with said one wheel to radial alignment with said at least one other wheel upon termination of the edge grinding operation at said one wheel.

* * * * *